US005242345A

United States Patent [19]

Mitchell

[11] Patent Number: 5,242,345

[45] Date of Patent: Sep. 7, 1993

[54] RETRACTABLE EXERCISE APPARATUS

[76] Inventor: Gary A. Mitchell, 38885 Godfrey Pl., Fremont, Calif. 94536

[21] Appl. No.: 795,716

[22] Filed: Nov. 21, 1991

[51] Int. Cl.[5] ..... A63B 21/06

[52] U.S. Cl. ..... 482/94; 482/39; 482/133

[58] Field of Search ..... 482/38, 41, 37, 112, 482/113, 133, 138, 142, 93-103, 39, 40; 248/317; 182/82, 95, 96

[56] References Cited

U.S. PATENT DOCUMENTS

| | | | |
|---|---|---|---|
| 332,989 | 12/1885 | Benedict | 482/133 X |
| 2,436,987 | 3/1948 | Bailleaux | 482/133 X |
| 3,139,949 | 7/1964 | Graves | 182/95 X |
| 3,741,538 | 6/1973 | Lewis et al. | 482/133 X |
| 3,874,657 | 4/1975 | Niebojewski | 482/142 X |
| 4,286,782 | 9/1981 | Fuhrhop | 482/133 X |
| 4,300,761 | 11/1981 | Howard | 482/138 X |
| 4,759,539 | 7/1988 | Nieppola | 482/37 X |
| 4,927,135 | 5/1990 | Nieppola | 182/75 X |
| 4,976,428 | 12/1990 | Ghazi | 482/112 X |

*Primary Examiner*—Robert Bahr

*Attorney, Agent, or Firm*—Robert Charles Hill

[57] ABSTRACT

An apparatus with which to perform numerous exercises including two elongated frame members which are hingably attached to a horizontal strut that may be fastened to a ceiling such as in a garage. Various items may be detachably secured to the frame when it is supported on the floor, including a squat rack that supports a barbell preparatory to its use in performing squats, a chinning bar, a tricep support for performing curls, a leg machine for performing leg extensions and leg curls, a cable and pulley arrangement for performing pull-downs, a bench for performing bench presses, etc. The frame is hinged to a strut that is fastened to the ceiling so that when it is desired to fold the apparatus away after the workout, it may be lifted on its hinges up to the ceiling where it is hooked until the next workout.

8 Claims, 5 Drawing Sheets

RETRACTABLE EXERCISE APPARATUS

BACKGROUND

1. Field of the Invention:

This invention relates to apparatus for performing numerous standard exercises with weights and particularly to an apparatus that is retractable for storage against a ceiling when not in use.

2. Prior Art and Information Disclosure Statement:

The development and marketing of equipment for performing resistance type exercise such as with weights has taken two directions. In one direction, the apparatus was initially developed to perform particular exercises for specific parts of the body. For example, special benches were developed to enable the user to perform bench presses; situp boards were developed to permit the user to perform situps; chinup bars were provided for chinups; squat racks were provided to perform squats. Sales of this equipment were targeted toward fitness clubs and gyms where many users were available for using each apparatus on a daily basis. The next stage in the evolution of exercise equipment was the development of single apparatus with several features that enabled the user to perform a number of the standard exercises. The UNIVERSAL apparatus is an example of this type of equipment. The early models of this type were well received as being a single apparatus that replaced a number of pieces however they were large and expensive so that they were also to be found primarily in public clubs and gyms.

Interest from the public in this type of exercise has continued to grow. However many members of the public have found that belonging to a club is too expensive and time consuming so that the demand has developed for smaller less expensive apparatus that would be placed in the home. Use of exercise equipment in the home locale poses a serious space problem for many would be users. Many people are apartment dwellers or live in small ranch style (single floor) houses whose design and space arrangement is not really compatible with the typical multistation exercise apparatus.

Apparatus has been disclosed which have attempted to resolve these problems.

For example, U.S. Pat. No. 4,369,966 to Silberman et al is for an exercise apparatus that includes an upstanding frame and a bench pivoted to the frame for movement between a laterally extended use position and an upright compact storage position juxtaposed with the frame. The apparatus includes barbell support cradles, a squat rack and chinning bar, detachable devices for performing curls for the arms.

U.S. Pat. No. 4,749,190 to Jennings is for a bench of removable sections that may be adjusted for performing inclined or horizontal presses in which the resting position of the bar for bench presses is also adjustable. It also has a leg exercise member that is lockable in one position to perform leg curls and another position to perform knee extensions.

These apparatus are two examples of devices that may be folded so as to reduce the space required for storage. However they still do occupy floor space so that their design does not fully accomplish the results for which they were intended.

THE INVENTION

OBJECTS

It is an object of this invention to provide an apparatus which can be used to perform a number of exercises. The exercises include leg extensions, leg curls, arm curls, flat bench presses, incline bench presses, dumbell flys, abdominal leg raises, squats, chinups.

It is another object that the apparatus may be folded and swung to an overhead storage postion such as in a garage when not in use.

It is another object that the apparatus be sturdy and be readily stored overhead with little effort by the user.

SUMMARY

This invention is directed toward an apparatus that is hingably attached to a ceiling providing that when the apparatus is not in use, it may be rotated on its hinged attachments to a position against the ceiling.

The apparatus includes strut members that are secured against the ceiling. Two channel members each have an end hingably attached to a strut member and extend vertically downward so that their other ends are in proximity to the floor when the apparatus is in use. A horizontal beam extending between vertical channels supports one end of a bench. The other end of the bench is supported by a short frame that rests on the floor. The bench is sectioned providing that a section of the bench may be inclined to perform incline presses or positioned horizontally for the user to perform presses in the prone position. A removable leg machine may be attached to one end of the bench on which weights may be loaded so that a user may lie on the bench and perform leg curls or knee extensions. A preacher curl pad may be removably attached between the uprights permitting the user to support his triceps against the pad and perform curls. A squat rack is attachable to the rack for performing squats. A bar is attachable to the rack for performing dips and chins ups. The preacher curl pad can also be attached to the squat rack. For storage purposes, the hinged attachment of vertical supports to the struts secured to the ceiling permits the user to swing the apparatus against the ceiling with the help of a weight tree attached to the apparatus by a cable.

DRAWINGS

DESCRIPTION OF THE BEST MODE:

The following detailed description illustrates the invention by way of example and not by way of limitation of the principles of the invention. This description will clearly enable one skilled in the art to make and use the invention and includes adaptations and modifications including what I presently believe to be the best mode for carrying out the invention.

Figure 1:
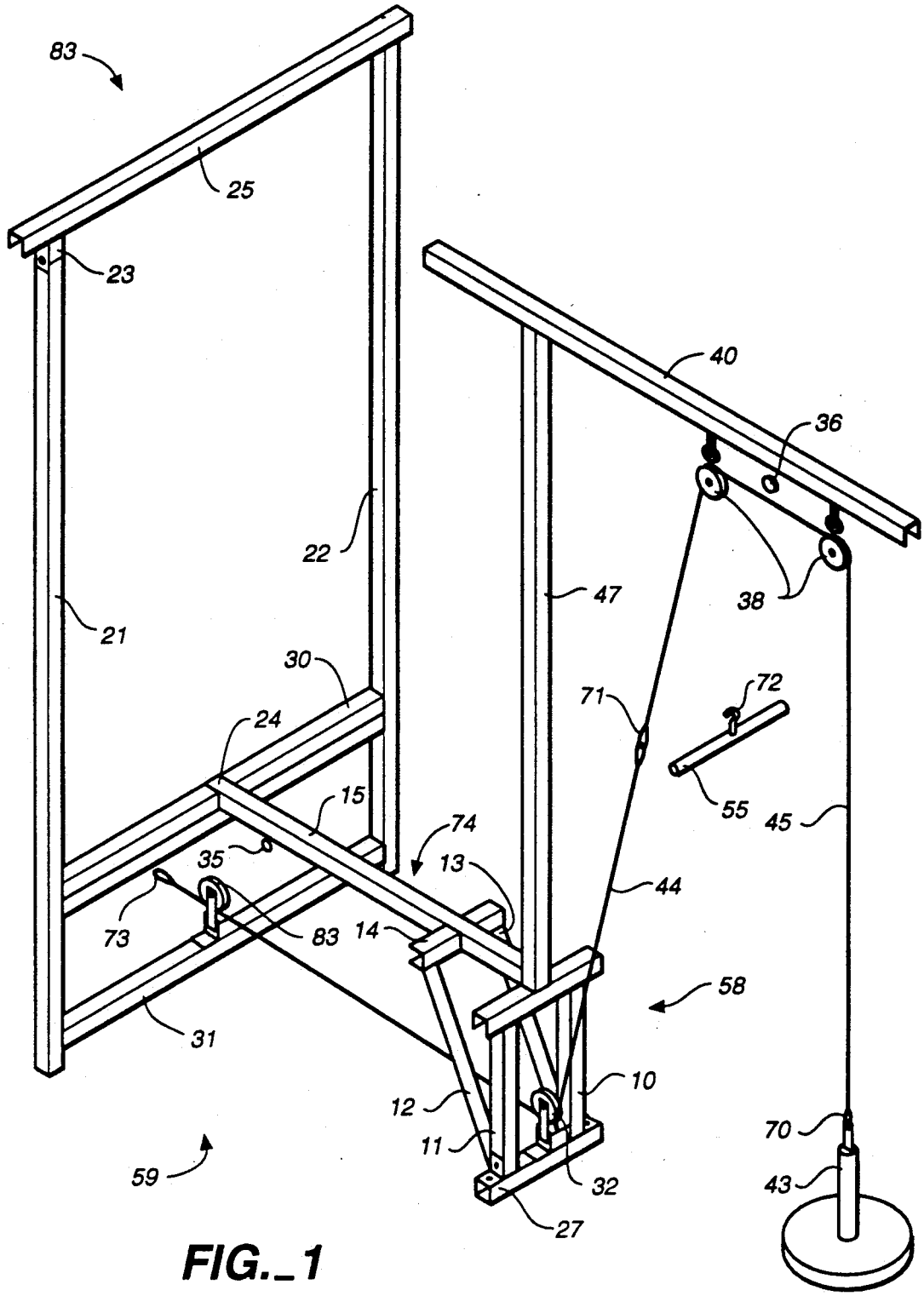
FIG. 1 shows the apparatus in position ready for use with the bench pads removed to illustrate details of the bench assembly.

Turning now to a discussion of the drawings, there is shown in FIG. 1 an exercise apparatus 83 of this invention.

There is shown a horizontal strut 25 which is secured to a ceiling, e.g. the joists in a garage. Two main support channel members, 21 and 22, each having an end hingably attached by hinging brackets 23 and 24 to each end of the strut 25 (only one end of 25 is shown in FIG. 1), are swung down to the vertical orientation as shown in FIG. 1 when the apparatus is in use.

Figure 2:
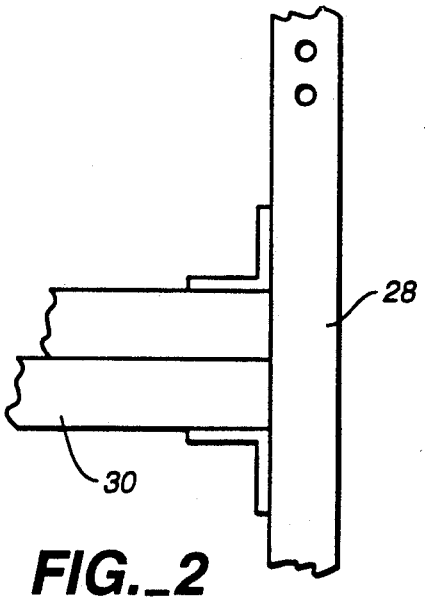
FIG. 2 shows details for joining the horizontal strut to the main channel support members.

A horizontal double strut 30 has an end attached to each channel member, 21 and 22, and has a notch 24 in its center for removable attachment to one end of a horizontal rail 15 which is part of a bench assembly 74 comprising rails 15 and 14. FIG. 2 is a sectional view taken along line of sight AA in FIG. 1 showing details of the attachment of the ends of strut 30 to the vertical channel 21.

A bench pad comprising section 16 (not shown in FIG. 1 but shown in FIG. 8 and FIG. 4) is hingably secured to pad section 75 mounted on the bench assembly 74.

Figure 3:
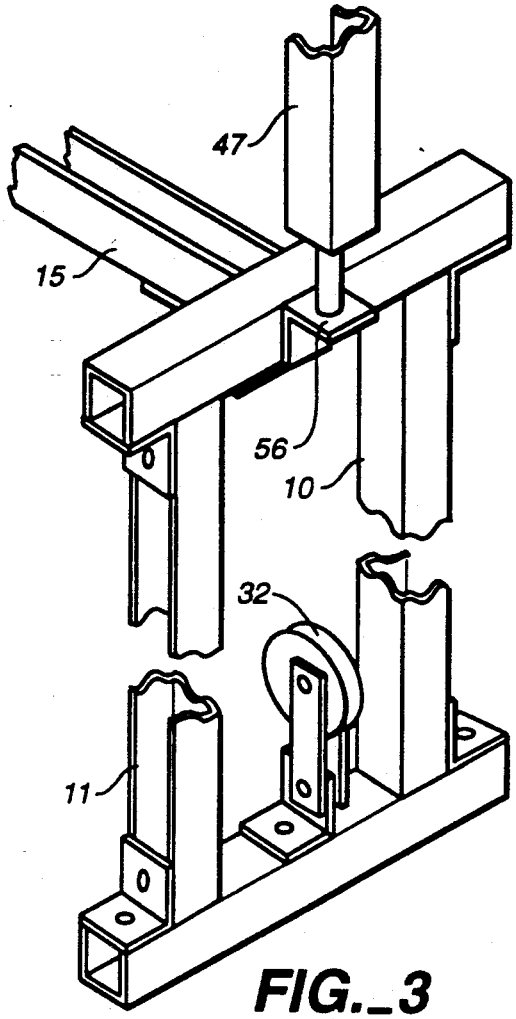
FIG. 3 shows details of the bench support frame.

Referring again to FIG. 1, the other end of the rail 15 is supported by a foursided frame 58 (comprising frame members 10, 11, 26, 27) whose lowest member 27 rests on the ground. Additional strength for supporting the bench pads is provided by cross members 14 welded to the rail 15 and gusset support members 12 and 13. An additional vertical channel 47 for stabilizing the bench has an upper end attached to a ceiling strut 40 (shown in FIG. 1) and a bottom end that is bolted to an angle bracket 56 secured to the bench support frame. This construction is shown to best advantage in FIG. 3.

Figure 4:
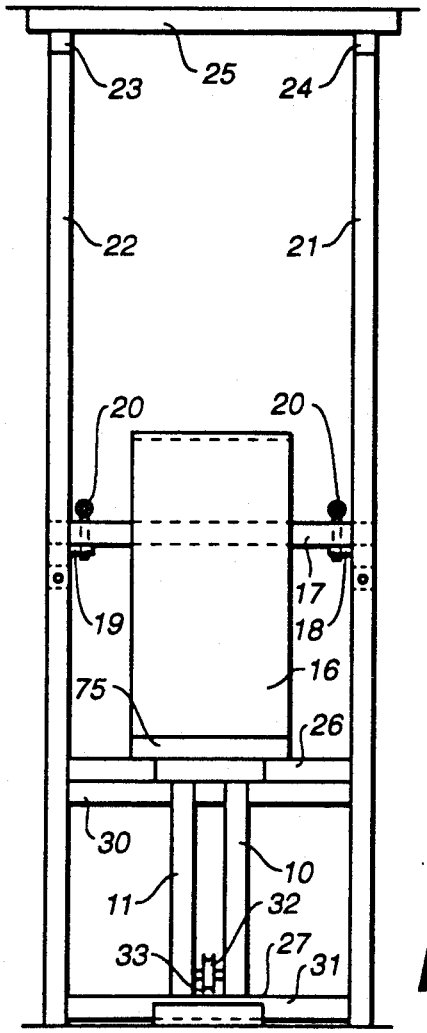
FIG. 4 shows a front view of the apparatus with the bench section raised for incline presses.
Figure 6:
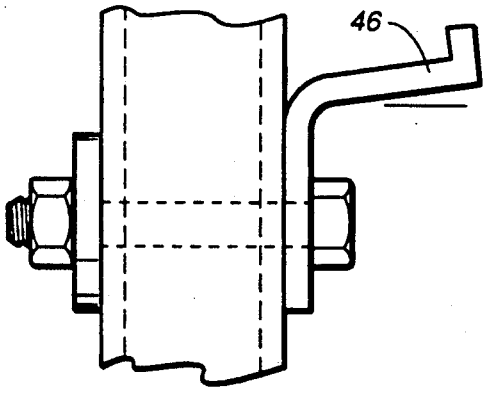
FIG. 6 shows details for attaching the Olympic bar support to the main support channels.

FIG. 4 shows an additional horizontal strut 17 removably attached at each end by brackets 18 and 19 to vertical channels 21 and 22 respectively to provide a support for a section 16 of the bench cushion to support the users back in an inclined position for performing incline presses. FIG. 6 shows catches 46 that may be bolted to the vertical channels, 21 and 22, to provide a resting position for an Olympic bar when the user is performing bench presses while lying on the bench.

The user may lie on the bench and perform a number of exercises that are well known in exercise physiology. These include "dumbell flys, dumbell bench presses and abdominal leg raises".

Figure 5:
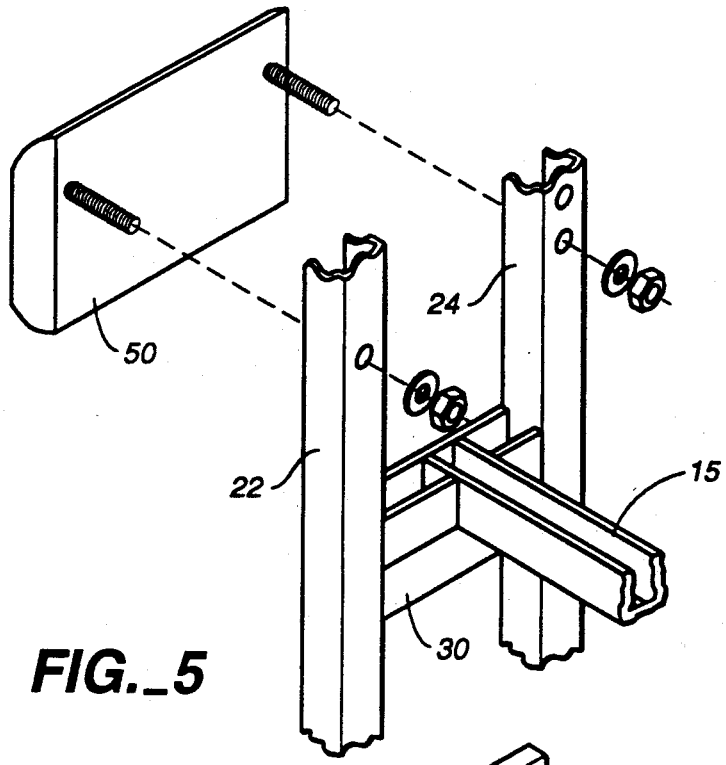
FIG. 5 shows details for securing the "preacher" pad against the main support channels or squat rack for performing curls. The squat rack is usually favored.

FIG. 5 shows a "preacher" pad 50 having ends that may be bolted to vertical channels 21 and 22 or 53 and 54 enabling the user to sit on either end of the bench and perform curls with his triceps supported against the "preacher" pad 50.

Figure 7:
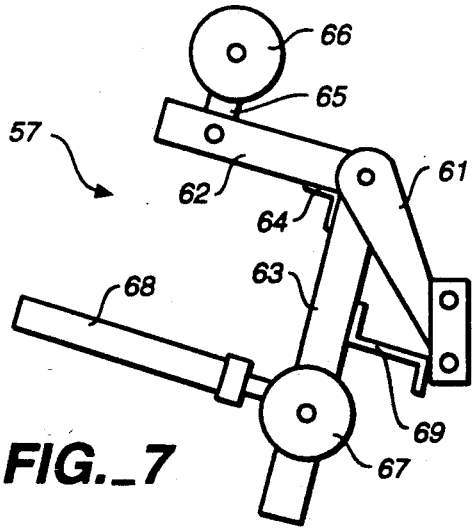
FIG. 7 is a side view showing details of the leg machine.
Figure 8:
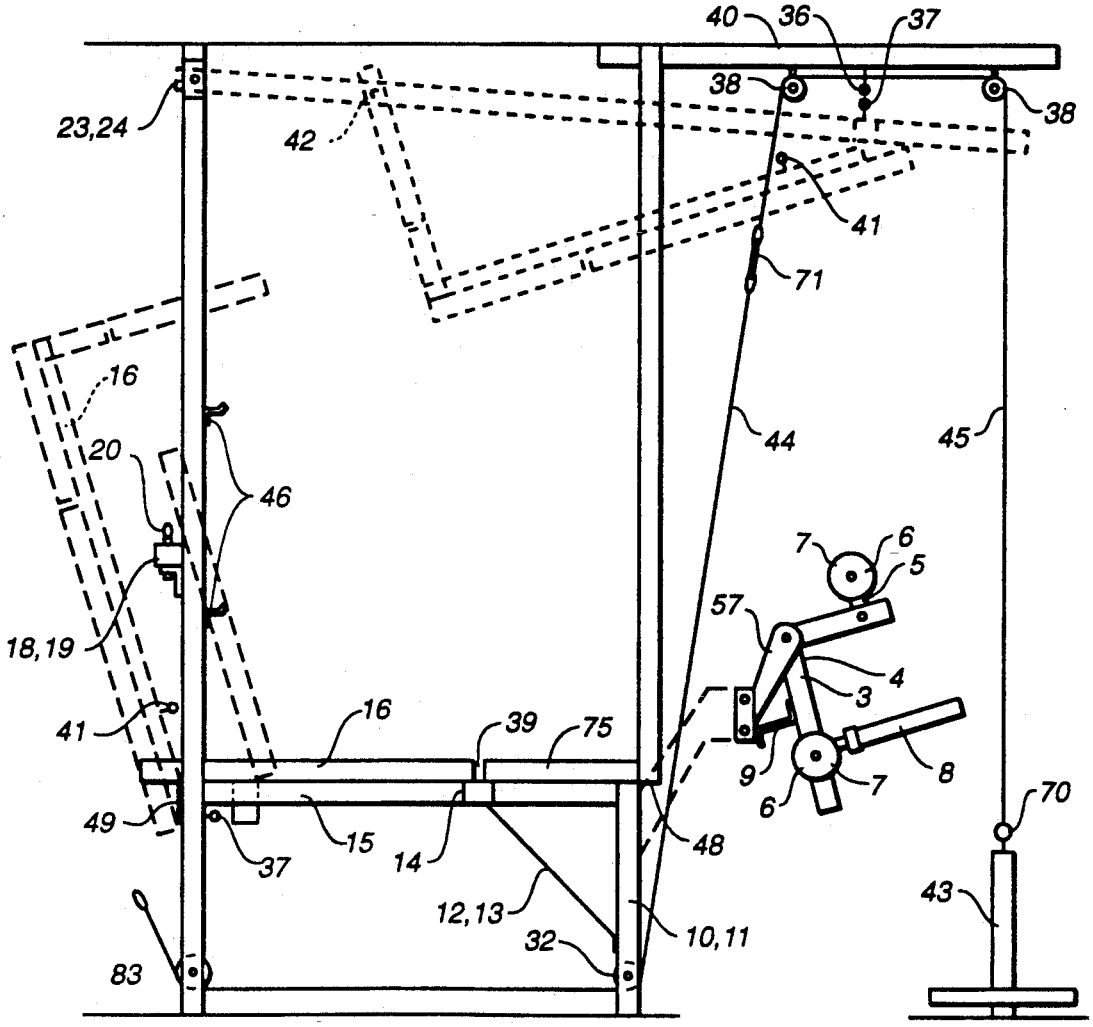
FIG. 8 shows a side view of the apparatus illustrating the means for storing the apparatus against the ceiling.
Figure 9:
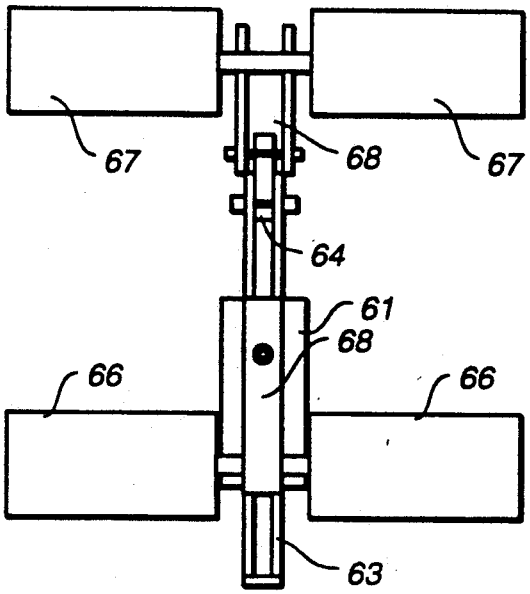
FIG. 9 is a frontal view showing details of the leg machine.

FIG. 8 shows a leg machine 57 attachable to the bench support frame 58. The leg machine is shown to better advantage in FIGS. 7 and 9. FIG. 7 is a side view and FIG. 9 is a front view showing details of the leg machine 57 attachable by bracket 61 to frame members 10 and 11 of the bench support frame 58. The leg machine 57 includes an upper member 62, a lower member 63, an angle bracket 64, a pivot bracket 65, upper and lower cushions 66 and 67, adapter 68 for an Olympic sleeve, and a leg stop 69.

The leg machine 57 is used to perform leg extensions and leg curls.

In order to perform leg extensions, the user sits on the end of the bench 16 and places his shins or bridge of his foot behind the lower pads, 67. He performs the exercise by straightening his knees thereby causing the leg machine to pivot about pin 78 thereby lifting weights (not shown) placed on the bar adapter 68.

In order to perform leg curls, the user lies face down on the bench pad 16 with his calves or heels under upper pads, 66. Then he bends his knees thereby pivotally lifting the weight (not shown) on the bar adapter 68. Pivoting of the leg machine is limited by stop 69.

FIG. 1 shows a cable arrangement used to perform a number of exercises which involves lifting weights (not shown) placed on weight adapter 43. A quick disconnect 70 provides for conveniently disconnecting cable 45 in order to change the weight placed on adapter 43. The cable 45 is threaded through pulleys 38 attached to the over head strut 40 and is then directed back toward the bench 16 to quick disconnect 71.

In a first mode, the user may attach the disconnect 71 to disconnect 72 of cable bar 55.

In this mode, the user may stand in front of the bench, grab the cable bar in both hands and pull down on the bar thereby lifting the weight in various ways to perform exercises that are well known in exercise physiology. These exercises include tricep pull downs, tricep push downs, bicep pull downs performed in the sitting position as well as front lateral pull downs and back lateral pull downs performed in the kneeling position.

In a second mode, the user may attach disconnect 72 to one end of cable 44 as shown in FIG. 1. Cable 44 is threaded through pulley 32 in the bench support frame 58 then through pulley 83 attached to cable support strut 31 at the opposite end of the bench. The far end 73 of cable 44 may be attached to disconnect 72 of cable bar 55.

In the second mode, the user can sit on the far end of the bench with his feet against the cable support strut 31 and perform exercises well known in the exercise physiology art such as seated rows. Curls, tricep pullovers and cable pullups are performed in the standing position.

In a third mode, the user attaches an ankle strap (not shown) to disconnect 73. With his ankle secured in the ankle strap, he performs leg cross overs by standing with his shoulders parallel to the cable and pulling on the cable by crossing his leg over the other either in front or in back.

Figure 10:
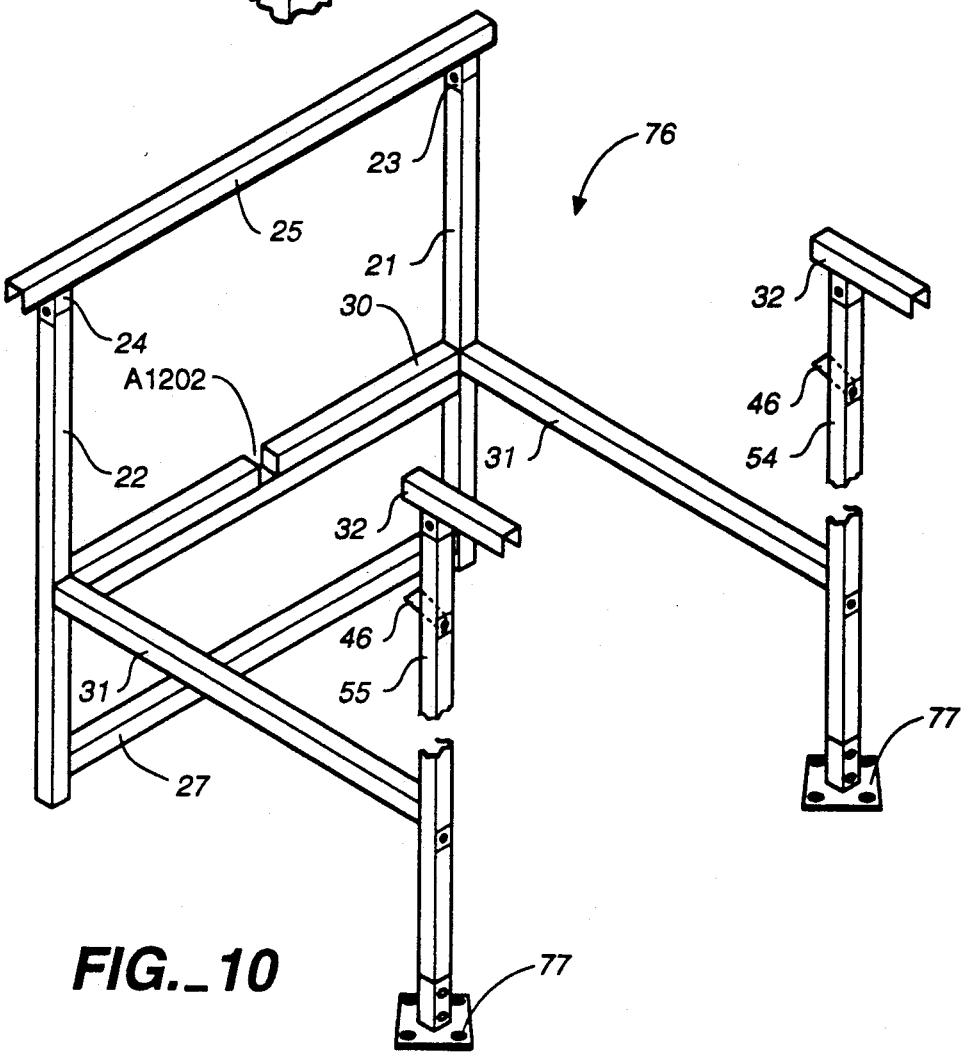
FIG. 10 shows details of the rack attachment for performing squats.

FIG. 10 shows the apparatus with the bench assembly 74 replaced by a squat rack assembly 76. The bench assembly has been oriented into A shown in phantom in FIG. 8 The squat rack assembly 76 includes two vertical channel members, 53 and 54, extending from ceiling struts 52 (each fastened to the ceiling, e.g., to ceiling joists). The lower end of each vertical channel member, 53 or 54, is supported on the floor by a post base 77.

Two horizontal squat rack safety bars 51 are shown. Each bar has one end secured to a vertical channel support, 53 or 54, and an opposite end detachably secured to a neighboring main support channel member 21 or 22 respectively. An Olympic bar support 46 is mounted on each vertical squat support channel, 53 and 54.

In order to perform the squat exercise, the user positions a barbell with the bar on the supports 46. Then the user stands under the bar and lifts the barbell with the bar on his shoulders. Then he takes one step forward. When he performs the exercise by squatting, the safety bars are under the barbell so that they may "catch" the barbell in the event the barbell is too heavy for the user.

Figure 11A:
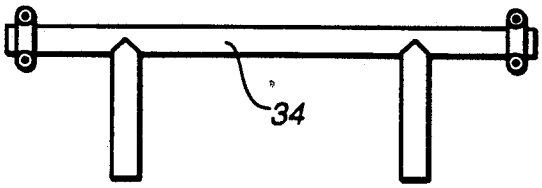
FIG. 11 shows a detachable combination pullup and dip bar.
Figure 11B:
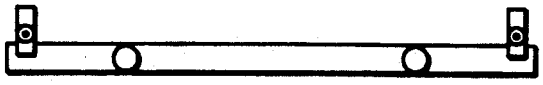
Figure 11C:
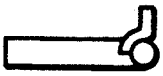

FIGS. 11*a, b* and *c* show respectively the plain, elevation and side views of a combination pullup and dip bar 34 that may be attached to the bench or squat assembly.

FIG. 8 shows that, when the workout has been completed, the apparatus can be pulled upward and attached against the ceiling. FIG. 8 is a view of the apparatus in position for use. In order to store the apparatus against the ceiling, seat sections 16 and 74 are rotated counterclockwise on hinge 49 to the dashed line position UP.

The seat sections, 16 and 74, are secured in this UP position by a retaining pin 42 in the main channel support section 21 and 22. Then the entire apparatus is raised to the STORE position against the ceiling by rotation of the main channel support sections about pivot brackets 23 and 24. This is conveniently accomplished by attaching quick connect 71 on cable 45 to an eyebolt 41 on the bench and attaching the weight tree to the other end of cable 45 and adding weights to the weight tree in order to assist in raising the apparatus. It is secured in the STORE position by attachment of eyebolt 36 on the main support frame to eyebolt 37 attached to the main support channel.

In the foregoing paragraphs an apparatus has been described which meets the objects of this invention. A suport frame includes to support channels to which may be attached an exercise bench, a squat rack, a pullup bar. A cable-pulley arrangement is provided with which the user may perform additional exercises. The apparatus in its entirety enables the user to obtain a total body workout. When the user wishes to store the apparatus, he simply folds the bench and lifts the apparatus to a position against the ceiling where it is secured. The apparatus may thereby be used and stored in locations such as a garage where the floor space must be used alternatively for exercising and parking the car.

A major feature of this invention is the capability to store the apparatus against the ceiling. Modifications may occur to one having ordinary skill in the art after reading the description and studying the drawings These modifications are within the scope of this invention. I therefore wish to define the scope of my invention by the following claims and in view of the specification.

I claim:

1. An exercise apparatus which comprises:

a frame means having an end positionable on a ground surface;

a bench means for performing exercises while sitting or lying on said bench having a first end detachably secured to said frame and a second end supportable against said ground surface when said apparatus is prepared for use in performing exercises; and means attached to said frame means and attachable to a ceiling above said ground surface in operable combination with said frame and bench means for folding said apparatus against said ceiling thereby storing said apparatus;

said frame means comprising two elongated main support members, each having a first end and a second end;

said storing means comprising a hinge means in operable combination with said elongated frame members for joining said first end to said ceiling providing that, when exercises are to be performed on said apparatus, said frame members are oriented vertically with said second ends in supported contact with said ground surface and when said apparatus is stored, said elongated main support members are oriented against and secured to said ceiling;

said storing means also comprising a horizontal strut means secured to said ceiling to which said hinging means is secured; and a pulley means and a cable means having one end attachable to a bar and another end attachable to a weight means, all in operable combination with said bench and frame means to enable a user to sit on said bench means and pull on said bar means thereby lifting said weight means to perform exercises.

2. An apparatus as in claim 1 wherein said pulley means comprises:

a first pulley secured to said storing means;

a second pulley secured to said storing means;

a third pulley secured to said first end of said bench means;

a fourth pulley secured to said second end of said bench means; and, said cable means comprises:

a first cable section threaded through said first and second pulleys and having one end connectable to said weight means and a second end with a quick disconnect;

a second cable section threaded through said third and fourth pulleys and having a quick disconnect on each end;

a bar means having a quick disconnect means;

said pulleys and cables in operable arrangement with one another to permit a user to attach said bar disconnect to said disconnect on said first cable section thereby enabling said user to sit on said first bench end and pull on said bar to lift said weight means thereby performing exercises and to permit said user to connect said bar disconnect to said cable adjacent to said second bench end, connect said second end of said first cable section to said other end of said second cable section and pull on said bar to lift said weight means and perform exercises.

3. An apparatus as in claim 1 wherein a squat support rack means is attachable to said main support members when said bench means is in a raised positions, said squat support rack means comprising:

two vertical weight support members, each having a first weight support end in supported contact with said ground surface and a second end;

a barbell support means for detachably supporting a barbell on said weight support members;

means for attaching said second ends of said weight support members to said ceiling over said ground surface;

horizontal strut members, each having an end attached to one of said vertical weight support members and another end attached to one of said main support members;

said strut members and said weight support members and said barbell support means operably arranged in combination with one another and said main support means to permit a user to perform squats by initially supporting said barbell on said barbell support means then lifting said barbell from said barbell support means onto his shoulders, squat with said struts positioned to protect said user, then return said barbell to said barbell support means.

4. An apparatus as in claim 1 which comprises:

two vertical squat support members, each having an end attached to said horizontal strut means;

a pad means attachable to said elongated main support members or said squat support members in operable arrangement with said bench means for performing curls with a barbell while supporting triceps of said user on said pad means.

5. An apparatus as in claim 1 which comprises a bar means attachable to and in operable combination with said elongated main support members for enabling a user to perform pullups and dips.

6. An apparatus as in claim 1 wherein said bench means comprises;

a horizontal strut having one end secured to one said elongated main support member and another end secured to said other elongated main support member;

a rail member having one end in supported engagement with said horizontal strut intermediate said ends of said strut;

a frame including two legs each having an end attached to respective ends of a ground support member and each having an end attached to respective ends of a fourth member secured to another end of said rail thereby providing that said frame member may support said rail member;

a seating pad supported by said rail providing that when said apparatus is positioned for performing exercises said user may lie on said pad and perform situps.

7. An apparatus as in claim 6 which comprises a bar support means secured to each main support providing that a barbell may be supported in a resting position by said bar support means enabling a user to perform bench presses.

8. An apparatus as in claim 6 which comprises:

a leg machine hingably attachable at a location adjacent to said bench support frame means; and, said leg machine comprises:

a weight support means extending from said location;

a means for a user to hook his heels to said leg machine when he is lying face down on said bench said heel hooking means operably arranged in combination with said weight support to provide that a user may perform leg curls by bending his knee thereby causing said weight support means to pivot and resist said bending;

a means for a user to hook the bridge of his feet to said leg machine when he is sitting on said bench, said bridge hooking means operably arranged in combination with said weight support means to provide that a user may perform knee extension exercises by straightening his knee thereby causing said weight support means to pivot and resist said straightening.

* * * * *